United States Patent [19]

Gerding et al.

[11] 4,359,202

[45] Nov. 16, 1982

[54] APPARATUS FOR BOTTOM CASTING METAL INGOTS

[75] Inventors: Charles C. Gerding; Joseph M. Stoll, both of Pittsburgh; Harold L. Majors, Aliquippa, all of Pa.

[73] Assignee: Jones & Laughlin Steel Corporation, Pittsburgh, Pa.

[21] Appl. No.: 120,427

[22] Filed: Feb. 11, 1980

[51] Int. Cl.[3] ..... B22D 7/06; B22D 41/08

[52] U.S. Cl. ..... 249/109; 164/133; 249/110

[58] Field of Search ..... 249/109, 110, 174; 164/129, 133, 363, 337

[56] References Cited

U.S. PATENT DOCUMENTS

| | | | |
|---|---|---|---|
| 961,854 | 6/1910 | Gathmann | 249/174 |
| 1,298,034 | 3/1919 | Gathmann | 164/337 X |
| 1,626,342 | 4/1927 | Hurst et al. | 222/591 |
| 2,409,779 | 10/1946 | McWane et al. | 164/337 |
| 3,299,480 | 1/1967 | Woodburn, Jr. et al. | 249/109 X |
| 3,532,154 | 10/1970 | Balevski et al. | 164/337 X |
| 3,672,432 | 6/1972 | Widdowson et al. | 249/109 X |

FOREIGN PATENT DOCUMENTS

| | | | |
|---|---|---|---|
| 1499318 | 2/1978 | United Kingdom | 249/109 |

OTHER PUBLICATIONS

Hase, H. W. et al., "Refractory Material for Continuous Casting", In Concast News, vol. 10, No. 1, 1971, pp. 3–5.

*Primary Examiner*—Gus T. Hampilos
*Assistant Examiner*—J. Reed Batten, Jr.
*Attorney, Agent, or Firm*—John Stelmah

[57] ABSTRACT

Nozzle apparatus and method for controlling molten metal flow in a bottom pour casting system whereby a fluid passage is defined wherein the flow is controlled to minimize splashing of the molten metal in the molds and the flow distribution is better equalized among a plurality of molds which are being simultaneously charged.

9 Claims, 7 Drawing Figures

APPARATUS FOR BOTTOM CASTING METAL INGOTS

BACKGROUND OF THE INVENTION

1. Field of the Invention

This invention relates to method and apparatus for economical simultaneous bottom casting of a plurality of metal ingots. The invention more particularly relates to a nozzle device for insertion in the bottom of an ingot mold for controlling the introduction of a molten charge in a bottom pouring process. The invention further relates to means for controlling the distribution of a molten charge amongst a plurality of ingot molds which are being simultaneously poured. The invention still further relates to deterring the splashing of a molten charge in a bottom poured ingot mold.

2. Description of Prior Art

In U.S. Pat. No. 3,810,506, there is disclosed ingot making apparatus which includes an anti-splash device in the form of a refractory board set at the bottom of the mold in which bottom pouring is conducted to interrupt a spouting stream of molten metal issuing from the run-out hole. The flat board is larger than the diameter of the run-out hole and can rise and float on the top surface of the molten metal within the mold.

SUMMARY OF THE INVENTION

The present invention provides method and apparatus for casting metal ingots in a manner whereby the advantages of bottom-pouring are utilized and the disadvantages are minimized. The invention provides a technique for controlling the introduction of a molten charge in a bottom-pouring process whereby splashing of the molten charge in the molds is minimized and the molten charge flow distribution among a plurality of molds being simultaneously charged is better equalized. The invention is particularly adapted for use in conjunction in bottom pour systems wherein the ingot molds are positioned big end up during charging and provides for the formation of a reduced cross-sectional area connection of the solidified ingot with the solidified sprue of the feed runner system to facilitate parting of the ingot from the sprue during the stripping of the mold from the stool base.

According to the present invention, there is provided a nozzle for insertion in a system for casting metal ingots wherein a plurality of the molds are simultaneously charged from a common pouring tube through runners leading to the molds. The nozzle of the invention provides a means for facilitating the flow of the molten charge from the runners into the individual molds in a manner whereby a sizable drop in hydraulic pressure is created through the nozzle to enhance equal flow distribution among the molds. The nozzle defines an inlet port to the mold which port has a reduced cross-sectional portion and an enlarged inlet port entry portion, each of which portions, individually and collectively contribute to the enhanced hydraulic pressure drop feature. The provision of a reduced cross-sectional portion in the nozzle provides means which serve to define an ingot sprue having a corresponding reduced cross-section and facilitates the breaking away of the ingot away from the stool. The use of the enlarged inlet port also tends to reduce the forward velocity of the charge from the runners into the molds and thereby serves to reduce splashing of the molten metal in the molds. The forward velocity of the charging metal may be further decelerated by providing the enlarged inlet port with relatively sharp corners at the end of inlet port leading to the reduced cross-sectional portion. The provision of the sharp corners at the reduced cross-sectional portion produces an ingot within the mold with a sprue extending therefrom having a concentration of mechanical stresses at the zone corresponding to sharp corners. Such concentration of mechanical stresses also makes it easier to break away the ingot and ingot mold during the stripping of the mold from the mold stool base. The nozzle may be additionally provided with an external configuration such that will prevent the nozzle insert from being pulled up with the ingot during the stripping procedure.

BRIEF DESCRIPTION OF THE DRAWING

Preferred embodiments of the invention are illustrated in the drawing, wherein.

DETAILED DESCRIPTION OF THE INVENTION

The invention is particularly adapted for use in conjunction with the teeming or casting of steel ingots and hence will be described in that connection.

Figure 1:
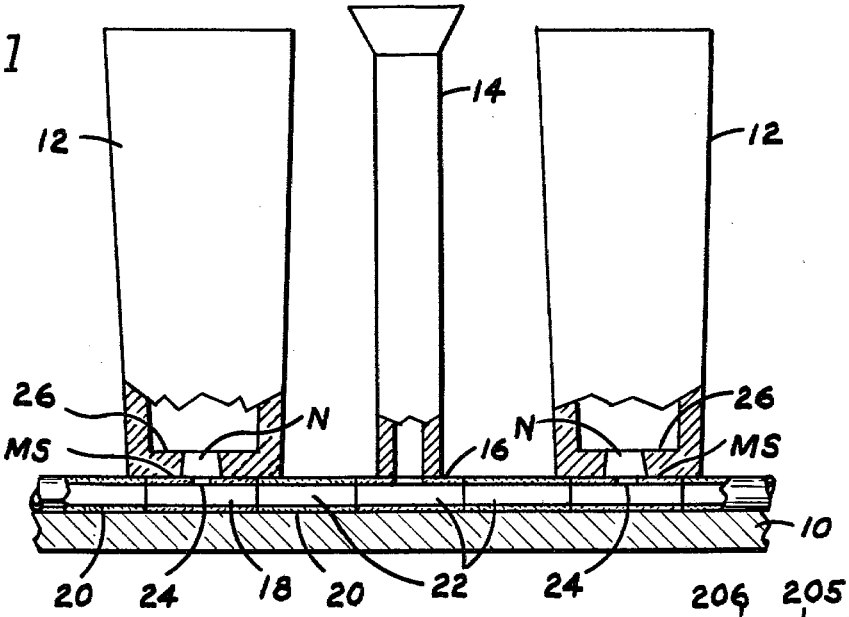
FIG. 1 is a side elevational view, partially in cross-section, of the ingot casting system of this invention shown in conjunction with big-end up bottom pouring molds.

FIG. 1 illustrates a conventional mold stool or base 10 having a plurality of ingot mold stations MS over which are positioned a plurality of ingot molds 12 and a pouring tube 14, which forms a fountain for the molds 12. Although only two mold stations MS are illustrated, it will be understood that a greater number may be used and are preferably arranged in a symmetrical pattern about the pouring tube 14. A manifold runner system 16 extends from the lower end of the pouring tube 14 to the molds 12. The manifold system is usually formed by channels 18 which are lined with refractory tile 20 defining passages 22. Each passage 22 extends to one or more discharge ports 24 leading to ingot mold stations MS.

In FIG. 1, the discharge port 24 is shown as leading directly to the bottom wall 26 of ingot mold 12. There is inserted a nozzle N which forms a feature of this invention. The nozzle N, which is preferably molded of refractory material, may be of multiple piece construction such as illustrated in FIG. 3, or of unitary construction, such as illustrated in FIG. 6.

Figure 5:
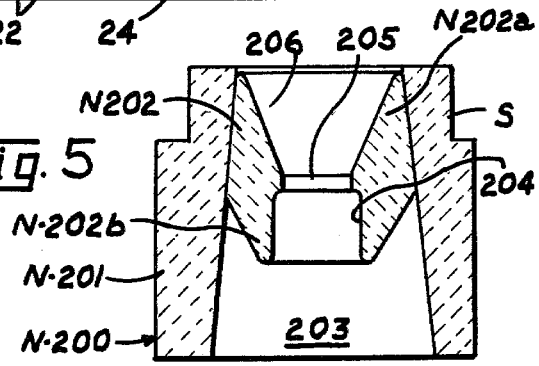
FIGS. 5, 6 and 7 are side elevation cross-sectional views of alternate forms of nozzles of this invention.
Figure 4:
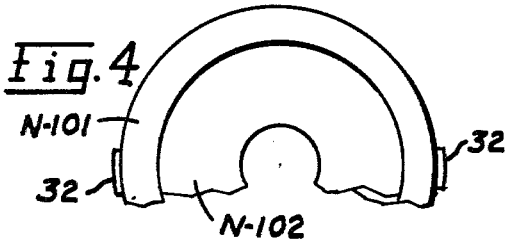
FIG. 4 is a fragmentary plan view of the nozzle shown in FIG. 3.
Figure 6:
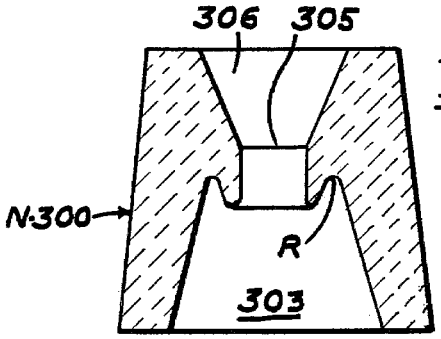
Figure 3:
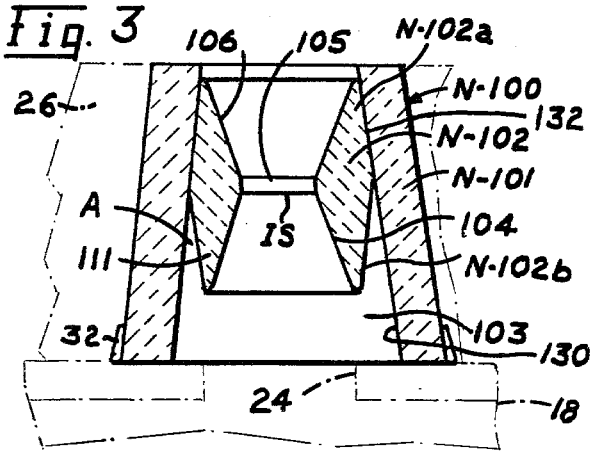
FIG. 3 is an enlarged side elevation cross-sectional view of a nozzle forming a part of this invention.
Figure 7:
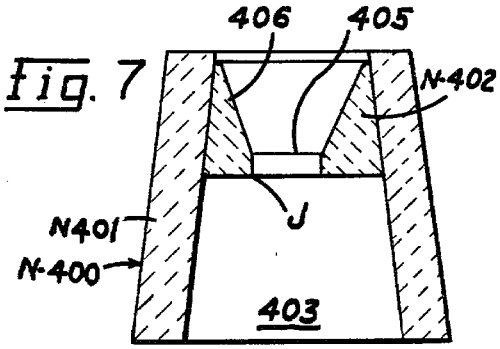

The nozzle N shown in FIG. 3 is designated by the reference numeral 100, i.e., N-100, and is illustrated as comprising two sections N-101 and N-102, whereas the nozzles N shown in FIGS. 5, 6 and 7 are further designated by the reference numerals 200, 300 and 400, respectively. Corresponding parts in the various embodiments bear the same last two digits in the respective reference numerals.

As seen in FIG. 3, the section N-101 forms an outer shell of the nozzle N-100, whereas the section N-102 forms an insert for the outer shell. The two sections N-101, N-102 define a first or lower cavity 103 in the passageway through the nozzle N-100. The section N-102 defines a second cavity 104 and has a skirt portion 111 which projects into cavity 103. The section N-102 also defines a third cavity or constriction 105 and a fourth or upper cavity 106 in the passageway.

It has been experimentally found that the extension of skirt portion 111 into cavity 103 imparts a shape to cavity 103 which reduces lateral components of velocity of the molten metal as it flows into cavity 106. It is believed that skirt 111 acts as a baffle toward any lateral movement of the molten metal as it flows upwardly into cavity 105; i.e., a major portion of any lateral movement of the molten metal that might otherwise occur because of the metal being reflected from the inside wall surface 130 is obviated.

The outer shell section N-101 may be of any external configuration, however, in order to facilitate ease of molding and to conserve material, e.g. by omitting volume of material at what would otherwise be corners, it is preferred to fabricate the section N-101 in the form of a frustum of an annular cone or pyramid. The taper of the frustum form also serves to deter the nozzle N from being pulled out of the wall 26 during the ingot stripping procedure. The section N-101 is also preferably provided with a tapered inside wall surface 130 to correspond substantially to the tapered wall 132 of section N-102.

The insert section N-102 is also preferably in the form which may be described as comprising two conical frustums, upper frustum N-102*a* and lower frustum N-102*b*, having coincident large bases. Although the frustums are illustrated as having small bases of equal diameters it is not necessary except to the extent that such form facilitates insertion of the insert N-102, either end first, into section N-101. As mentioned above, section N-102 also defines the third cavity 105 of reduced cross-section wherein the sprue extending from an ingot, while on the mold stool may be more easily fractured. The increased ease of fracture is facilitated by the small cross-sectional area of the sprue wherein a reasonable tensile force acting on a relatively hot metal therein, during stripping of the ingot mold, is greater than the tensile force due to the tensile strength of the solidified metal.

The insert section N-102 may be described as separately defining a fluid passage comprising a first cavity 104 having a bottom side which forms an inlet port; a second cavity 105 having an inlet side IS of less cross-sectional lateral area than the first cavity 104 whereby a constriction is formed in the passage and a third cavity 106 which expands the lateral cross-section and forms an outlet for the passage. Then when the insert N-102 is placed in the outer shell N-101 a fourth cavity 103 is defined by shell N-101 and the insert N-102. Since the skirt portion 111 extends into cavity 103 and away from wall surface 130 there is defined an annulus portion A at the top of cavity 103.

The cavity 106 preferably includes an outwardly tapering portion to serve as means for decelerating the initial flow of the molten metal and thereby minimize the "spurt" into the mold which normally occurs when the molten metal first flows from the channel 18.

To facilitate positioning of the nozzle N into the bottom wall 26, the section NS-101 may be provided with protuberances 32 which serve as wedges to hold the section in place and cement may be added between the outer surface of the nozzle and the wall 26.

It will be observed that the inlet port of cavity 103 is of greater dimension than the discharge port 24. This obviates the need to have the centers of the ports positioned exactly coincident upon placement of an ingot mold upon the mold stool.

In FIG. 5 there is illustrated another embodiment of the nozzle N which forms part of this invention. The nozzle N-200 there shown comprises an outer shell N-201 and insert N-202. The outer shell N-201 is shown as having a step formation S at its outer surface configuration to deter the nozzle from being pulled out of the wall during the ingot stripping procedure. Also, the configuration of insert N-202 is shown as being somewhat different from the insert N-102 shown in FIG. 3 in that cavity 204 is substantially cylindrical in shape whereas the shape of cavity 104 is more nearly that of the frustum of a cone. It will also be noted that insert N-202 has an external configuration resembling two conical frustums, upper frustum N-202*a* and lower frustum N-202*b*, having contiguous bases, the conical frustums are not mirror images of each other as they are in FIG. 3.

The embodiment of the nozzle shown in FIG. 6, designated by the reference character N-300, is very similar to that shown in FIG. 5 except that it is of unitized construction.

The parts in FIG. 6 bear the same last two digit reference characters as the corresponding parts in FIG. 5 but are in the three hundred series. Since the functions of the various components are the same as those shown in FIG. 5, it is believed no further description is necessary. It will be noted that the configuration of cavity 303 is slightly different from that of cavity 203 in FIG. 3 in that cavity 303 has a smooth radius R at the juncture of the vertical side with the top side of the cavity. This radius R is merely provided to facilitate the casting of the nozzle N-300 as a single piece.

FIG. 7 illustrates a still further embodiment of the nozzle apparatus of this invention designated by the reference N-400 and comprising outer shell N-401 and insert N-402. The insert N-402 has an external configuration corresponding to a conical frustum and defines cavity 405, which has a reduced lateral cross-section, as compared to cavity 403 defined by insert N-402 and outer shell N-401. The fracture of the metal sprue in cavity 405 may be further facilitated by a zone of increased mechanical stresses through the provision of a sharp edged junction J between the cavities which forms a weir in the passageway. In view of the stress concentration at this zone, in some instances it may be desirable to fabricate the portion defining the sharp edge at the junction J from a refractory having greater strength than other portions of the nozzle, e.g. by cementing a separate plate to the bottom portion of section N-402.

The embodiment shown in FIG. 3 is a preferred one because it permits the replacement of that part of the nozzle unit which wears first and/or the most without having to replace the entire nozzle each time.

Figure 2:
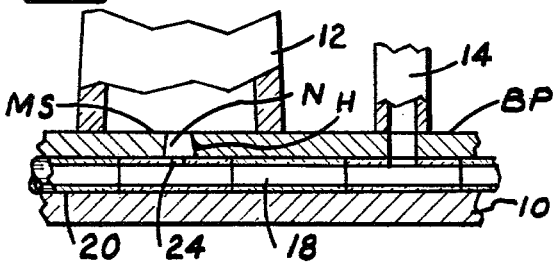
FIG. 2 is a side elevational view, partially in cross-section, of the ingot casting system of this invention shown in conjunction with a big-end down bottom pouring molds.

FIG. 2 illustrates the manner in which the nozzle N of this invention may be utilized in a big end down bottom pouring system. Here the nozzle N is positioned in an aperture H of an upper base plate BP forming part of the mold stool instead of in the ingot mold per se. The aperture H communicates with the manifold runner system 16 so that molten metal poured into tube 14 can flow into an ingot mold 12 in the same manner as in the embodiment shown in FIG. 1.

From the foregoing description it will be observed that there is provided a method of bottom pour casting molten metal poured into an upstanding pouring or feed tube communicating with a manifold runner system in an ingot mold stool or base; the runners communicate with ingot molds positioned over the base; the molten metal is caused to flow to the molds through nozzle passages having neck or weir portions wherein hydraulic pressure drops occur in the flow; the flow stream is then permitted to expand before reaching the ingot mold to decelerate the metal flow coming through the nozzle neck portion, the hydraulic pressure drop and deceleration of the metal flow contribute toward equalizing the metal flow amongst and deterrence of spurting into the ingot molds; after the metal solidifies sufficiently, the molds are stripped and by virtue of the small cross-section zones of the sprues formed in the neck portions, the ingots can be easily fractured and parted at such zones.

What is claimed is:

1. In bottom pouring apparatus wherein a plurality of upstanding ingot molds are simultaneously charged with molten steel in the absence of separate fluid pressure means through discharge ports of runners leading to the molds, the improvement wherein the molten steel flowing into each of said molds flows through a respective refractory nozzle leading from a discharge port of the runner over which the nozzle is mounted and wherein said nozzle includes:

(a) a fluid passage therethrough;

(b) means defining a first cavity having a bottom side forming an inlet port for said passage, said inlet port having a lateral cross-section larger than the discharge port of said runner;

(c) means defining a second cavity having an inlet side of less cross-sectional lateral area than and communicating with said first cavity whereby a constriction smaller than the discharge port of said runner is formed in said passage; and (d) means defining a third cavity communicating with said second cavity, expanding within said nozzle the lateral cross-section of the passage from said second cavity and forming a top side outlet for said passage into the mold; and wherein:

said nozzle is positioned in the bottom wall of the mold.

2. In bottom pouring apparatus wherein a plurality of upstanding molds are simultaneously charged with molten steel through discharge ports or runners leading to the molds, the improvement wherein the molten steel flowing into each of said molds flows through a respective refractory nozzle leading from a discharge port of the runner over which the nozzle is mounted and wherein said nozzle includes:

(a) a fluid passage therethrough;

(b) means defining a first cavity having a bottom side forming an inlet port for said passage, said inlet port having a lateral cross-section larger than the discharge port of said runner;

(c) means defining a second cavity having an inlet side of less cross-sectional lateral area than and communicating with said first cavity;

(d) means defining a third cavity having a less cross-sectional lateral area than and communicating with said second cavity whereby a constriction smaller than the discharge port of said runner is formed in said passage; and (e) means defining a fourth cavity communicating with said third cavity, expanding within said nozzle the lateral cross-section of the passage from said third cavity and forming a top side outlet for said passage into the mold.

3. Apparatus, as described in claim 2, wherein said nozzle comprises:

(a) an outer shell, and (b) an insert for said shell, said insert defining said second and third cavities, and (c) said outer shell defining said first cavity.

4. Apparatus, as described in claim 3, wherein:

a portion of the insert defining said second cavity projects into said first cavity whereby an annulus is defined at the top of said first cavity.

5. Apparatus as described in claim 3 wherein:

said insert is in the form resembling a conical frustum.

6. Apparatus, as described in claim 2, wherein said nozzle comprises:

(a) an outer shell, and (b) an insert for said shell, said insert defining said second, third and fourth cavities, and (c) said outer shell and said insert defining said first cavity.

7. Apparatus as described in claim 6, wherein:

said insert is in the form resembling that of a pair of conical frustums having their bases coincident to each other.

8. Apparatus as described in claim 6, wherein:

said outer shell is in the form of an annular frustum of a cone.

9. Apparatus as described in claim 6, wherein:

said outer shell includes a step formation at its outer surface.

* * * * *